United States Patent [19]

Steiner

[11] 4,103,812

[45] Aug. 1, 1978

[54] BARREL CARRIER

[76] Inventor: Henry William Steiner, Box 18, Site 19, R.R. #1, Dryden, Canada

[21] Appl. No.: 807,543

[22] Filed: Jun. 17, 1977

[51] Int. Cl.[2] ..... B65D 71/00

[52] U.S. Cl. ..... 224/45 P; 294/34

[58] Field of Search ..... 224/45 P, 45 C, 45 M; 294/15, 16, 4, 29, 27, 27 H, 103, 34; 16/110.5, 114 R; 211/41; 24/243 B, 263 R

[56] References Cited

U.S. PATENT DOCUMENTS

| | | | |
|---|---|---|---|
| 224,137 | 2/1880 | Brown | 294/16 |
| 382,618 | 5/1885 | Mott | 294/4 |
| 1,556,228 | 10/1925 | Lewis | 294/16 |
| 2,542,621 | 2/1951 | Bober | 294/34 |
| 3,827,742 | 8/1974 | Holden | 294/16 |

FOREIGN PATENT DOCUMENTS

| | | | |
|---|---|---|---|
| 490,150 | 2/1953 | Canada | 294/16 |
| 948,290 | 6/1947 | France | 294/29 |

*Primary Examiner*—Trygve M. Blix
*Assistant Examiner*—Kenneth Noland
*Attorney, Agent, or Firm*—Stanley G. Ade

[57] ABSTRACT

The barrel carrier consists of upper and lower lip or rim engaging jaws formed on upper and lower support bars respectively. The two bars are telescopically connected together and can be detachably clamped in the desired position so that the jaws engage over the upper and lower rims of the barrel. The clamp bolts terminate in relatively large handles to facilitate the lifting of the barrel when the carrier is engaged thereon.

1 Claim, 6 Drawing Figures

FIG. 1
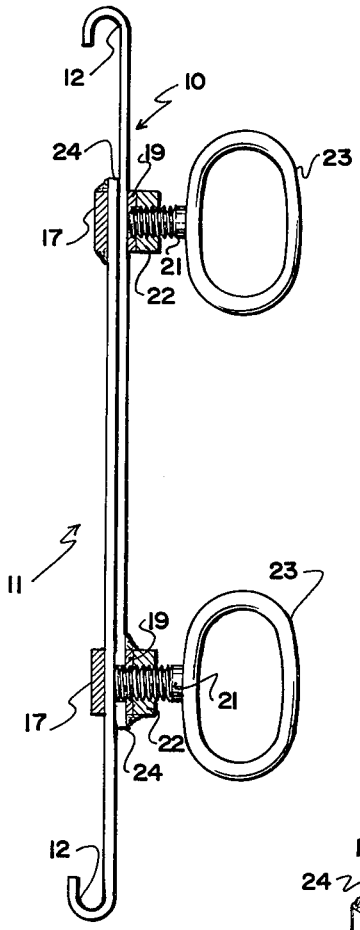
FIG. 2
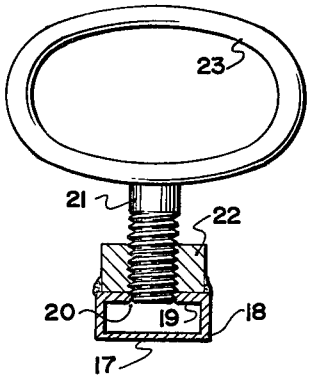
FIG. 3
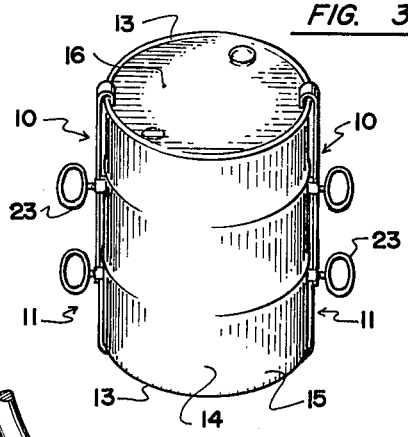
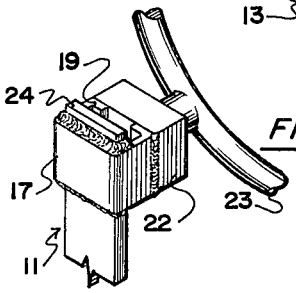
FIG. 4
FIG. 5
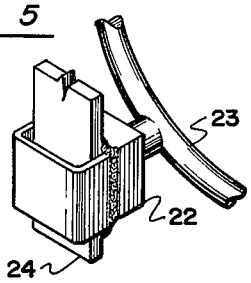
FIG. 6
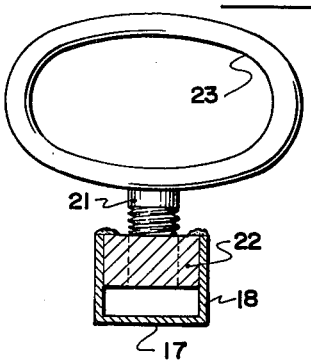

BARREL CARRIER

BACKGROUND OF THE INVENTION

This invention relates to new and useful improvements in barrel carriers. It is well known that it is difficult to move oil drums or the like or cylindrical barrels not only when they are full, but also when they are empty due to the awkwardness of the construction of said barrels.

SUMMARY OF THE INVENTION

The present invention overcomes these disadvantages by providing a barrel carrier which can be engaged over the upper and lower rims of barrels and includes means to clamp the carrier in position and has handles formed thereon to facilitate the lifting of the barrel once the carrier is clamped thereon.

One aspect of the invention consists of a pair of support bars, means connecting said bars together for lengthwise movement one with the other, means on the distal ends of each of said bars engageable over the upper and lower rims of the barrel respectively, means to clamp the bars into position upon the barrel with said means on the distal ends of the barrels engaging the rims as aforesaid and hand engaging means on at least one of said bars whereby said barrel may be lifted by said carrier.

Another aspect of the invention consists of a pair of flat, strap type bars, retainer bracket means on each of said bars adjacent one end thereof, each of said bars being slidably engageable within the retainer bracket means of the other of said bars whereby said bars may be adjusted lengthwise one relative to the other, a barrel rim engaging jaw formed on the other end of each of said bars, clamp means on each retainer bracket means to clamp the bars in the desired relationship and at least one hand engaging means on said carrier to facilitate lifting the barrel by said carrier.

An object of the invention is to provide a device which can readily be adjusted depending upon the height of the barrel and engaged over the upper and lower rims thereof whereupon it may be clamped into position to facilitate the lifting of the barrel particularly when empty.

A further object of the invention is to provide a device of the character herewithin described in which two such carriers can be used, one upon each side of the barrel, thereby facilitating the lifting of a full barrel by two men.

Still another object of the invention is to provide a device of the character herewithin described in which only one handle may be provided for light barrels or, two handles may be provided for relatively heavy or large barrels.

A yet further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

FIG. 1 is a side elevation of the preferred embodiment of the barrel carrier per se.

FIG. 2 is an enlarged top plan view of one of the sliding bracket and handle assemblies per se.

FIG. 3 is an isometric partially schematic view showing two carriers attached to a barrel, reduced in scale from the remaining drawings.

FIG. 4 is a fragmentary isometric view showing the top clamp assembly.

FIG. 5 is a view similar to FIG. 4, but showing the bottom clamp assembly.

FIG. 6 is a view similar to FIG. 2, but showing the preferred embodiment.

In the drawings like characters of reference indicate corresponding parts in the different figures.

DETAILED DESCRIPTION

Proceeding therefore to describe the invention in detail, reference should first be made to FIG. 1 which shows an upper strap or support bar collectively designated 10 and a lower strap or support bar collectively designated 11.

Each support bar 10 and 11 is preferably made from flat steel strip and a curved jaw 12 is formed on the distal end of each of the bars.

These curved jaws curve over and then parallel to the main length of the bar in the form of a hook thus permitting same to be engaged over the extending lip 13 of a conventional barrel 14.

The conventional barrel 14 includes the cylindrical wall portion 15, the aforementioned lips 13 and end panels 16, closing the ends of the cylindrical wall 15.

Means are provided to permit the two bars 10 and 11 to slidably move in a telescopic manner, one relative to the other, said means taking the form of a retainer bracket, one embodiment of which is shown in FIG. 2.

The bracket includes a rear wall portion 17, side wall portions 18 extending at right angles from the ends of the rear wall portion and a front wall portion 19 lying substantially spaced and parallel from the rear wall portion 17. This front wall portion 19 is apertured centrally as at 20 to permit passageway of a screw threaded clamp bolt 21 which is screw threadably engaged within a nut 22 welded to the front wall 19.

Hand engaging lifting 23 are formed on the end of the screw threaded bolt 21 as clearly illustrated.

When the retainer bracket assembly is used in the uppermost position shown in FIG. 4, the rear wall 17 is welded to adjacent the inner end 24 of the strap or bar 11 and when used in the lowermost position as shown in FIG. 5, the retainer bracket is welded to adjacent the distal end 24 of the other bar 10, by means of front wall 19 thereof.

The strap or bar 10 therefore slidably engages within the bracket welded to bar 11 and bar 11 slidably engages bracket welded to bar 10 so that the assembly is telescopic as clearly illustrated in FIG. 1.

When in the desired position, with the hooked ends 12 engaged over the rims 13 of a barrel, the clamp bolts 21 are tightened thus clamping the two bars together at both locations whereupon the barrel may readily be lifted by means of the hand engaging portions 23.

If the barrel is relatively heavy, two assemblies may be secured to the barrel at diametrically opposite sides thereof as shown in FIG. 3, thus permitting two operators to carry the barrel between them.

The apertures 19 within the front walls of the brackets may be screw threaded, if necessary, but it is preferable that the nuts 22 be used, with the nuts in turn being welded to the front walls as clearly illustrated.

FIG. 6 shows the preferred method of construction in which the sides 18 of the bracket are extended to embrace the nut 22 and are welded thereto as shown.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A barrel carrier for use with barrels having a cylindrical wall with upper and lower rims joining the upper and lower ends of the barrel and the upper and lower ends of the cylindrical wall respectively; comprising in combination a pair of flat, strap type bars, retainer bracket means rigidly attached on each of said bars adjacent one end thereof, each of said bars being slidably engageable within the retainer bracket means of the other of said bars whereby said bars may be adjusted lengthwise one relative to the other, a barrel rim engaging jaw formed intergrally upon the other end of each of said bars, a clamping bolt on each retainer bracket means, operatively engaging between said retainer bracket means and the strap bar slidably passing therethrough, to clamp the bars in the desired relationship, and a hand engaging handle on each of said clamp bolts rigidly secured thereto, to actuate said clamp bolts and to assist in the grasping of said carrier to lift the barrel to which said carrier is attached.

* * * * *